US006474235B2

(12) United States Patent
DeBoer et al.

(10) Patent No.: US 6,474,235 B2
(45) **Date of Patent: *Nov. 5, 2002**

(54) METHOD OF PREPARING A LITHOGRAPHIC PLATE

(75) Inventors: Charles D. DeBoer, Palmyra; Jeffrey W. Leon, Rochester; David M. Teegarden, Pittsford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 4 days.

This patent is subject to a terminal disclaimer.

(21) Appl. No.: 09/753,090

(22) Filed: Jan. 2, 2001

(65) Prior Publication Data

US 2002/0121208 A1 Sep. 5, 2002

(51) Int. Cl.[7] ..... B41C 1/10
(52) U.S. Cl. ..... 101/465; 101/457; 101/462
(58) Field of Search ..... 101/457, 462, 101/463.1, 465, 466; 347/95, 96, 100, 101, 102

(56) References Cited

U.S. PATENT DOCUMENTS

| | | | | |
|---|---|---|---|---|
| 1,941,001 A | | 12/1933 | Hansell | 347/102 |
| 3,373,437 A | | 3/1968 | Sweet et al. | 347/74 |
| 3,416,153 A | | 12/1968 | Hertz et al. | 347/73 |
| 3,878,519 A | | 4/1975 | Eaton | 347/75 |
| 4,003,312 A | | 1/1977 | Gunther | 101/466 |
| 4,156,616 A | | 5/1979 | Dietz et al. | 106/503 |
| 4,303,924 A | | 12/1981 | Young, Jr. | 347/102 |
| 4,346,387 A | | 8/1982 | Hertz | 347/75 |
| 4,599,627 A | | 7/1986 | Vollert | 347/101 |
| 4,833,486 A | | 5/1989 | Zerilllo | 101/463.1 |
| 5,279,654 A | | 1/1994 | Keirs et al. | 106/31.67 |
| 5,312,654 A | * | 5/1994 | Arimatsu et al. | 427/511 |
| 5,324,349 A | | 6/1994 | Sano et al. | 106/31.25 |
| 5,429,860 A | * | 7/1995 | Held et al. | 428/195 |
| 5,466,658 A | | 11/1995 | Harrison et al. | 503/227 |
| 5,495,803 A | | 3/1996 | Gerber et al. | 101/401.1 |
| 5,501,150 A | | 3/1996 | Leenders et al. | 101/466 |
| 5,511,477 A | | 4/1996 | Adler et al. | 101/401.1 |
| 5,695,908 A | * | 12/1997 | Furukawa | 101/466 |
| 5,738,013 A | * | 4/1998 | Kellett | 101/463.1 |
| 6,025,022 A | * | 2/2000 | Matzinger | 101/463.1 |
| 6,044,762 A | * | 4/2000 | DeBoer et al. | 101/466 |
| 6,050,193 A | * | 4/2000 | DeBoer et al. | 101/466 |
| 6,187,380 B1 | * | 2/2001 | Hallman et al. | 101/456 |
| 6,276,273 B1 | * | 8/2001 | Aurenty et al. | 101/457 |
| 6,341,560 B1 | * | 1/2002 | Shah et al. | 101/463.1 |

FOREIGN PATENT DOCUMENTS

| | | |
|---|---|---|
| EP | 0 766 763 | 6/1997 |
| JP | 56-105960 | 8/1981 |
| JP | 62-025081 | 2/1987 |

* cited by examiner

*Primary Examiner*—Stephen R. Funk
(74) *Attorney, Agent, or Firm*—Raymond L. Owens

(57) ABSTRACT

A method for preparing a lithographic plate which can react with an imaging fluid to form an image, including providing a hydrophilic support; forming a fluid-receiving layer that includes a water-soluble material which is chemically reactive with the imaging fluid; imagewise applying the imaging fluid to the fluid-receiving layer; and drying or curing the applied fluid to form an image in the fluid-receiving layer.

7 Claims, 1 Drawing Sheet

METHOD OF PREPARING A LITHOGRAPHIC PLATE

FIELD OF THE INVENTION

The present invention relates to forming lithographic plates.

BACKGROUND OF THE INVENTION

The art of lithographic printing is based upon the immiscibility of oil and water, wherein the oily material (or ink) is preferentially retained by image areas on a substrate. When a suitably prepared surface is moistened with water and an ink is applied, certain areas retain the water and repel the ink, and other areas accept the ink and repel the water. Ink can then be transferred to the surface of a suitable receiving material, such as cloth, paper or metal, thereby reproducing the image. Commonly, the ink is transferred to an intermediate material known as a blanket, which in turn transfers the ink image to the surface of the final receiving material upon which the image is to be reproduced.

Conventional lithographic printing plates typically include a hardenable polymeric layer (usually visible or UV light sensitive) on a suitable metallic or polymeric support. Both positive- and negative-working printing plates can be prepared in this fashion. Upon exposure, and perhaps post-exposure heating, either imaged or non-imaged areas are removed using wet processing chemistries.

Thermally sensitive printing plates are also known. They include an imaging layer comprising a mixture of dissolvable polymers and an infrared radiation-absorbing compound. While these plates can be imaged using lasers and digital information, they require wet processing using alkaline developers to provide the printable image.

Dry planography, or waterless printing, is well known in the art of lithographic offset printing and provides several advantages over conventional offset printing. Dry planography is particularly advantageous for short run and on-press applications. It simplifies press design by eliminating the fountain solution and aqueous delivery train. Careful ink water balance is unnecessary, thus reducing rollup time and material waste. Use of silicone rubber, [such as poly (dimethylsiloxane) and other derivatives of poly(siloxanes)] have long been recognized as preferred waterless-ink repelling materials. However, contamination of the plate by paper fibers which are no longer washed away by the fountain solution, limit the run length of such plates.

Herein, ink-repelling materials are defined as "oleophobic" and, conversely, the term "oleophilic" is used to describe ink "loving" or accepting materials.

The planographic materials noted above are the object of considerable development effort in the industry, but due to a number of performance problems or costs, there remains a need to explore other means for providing printed images using sources of digital information, such as digitally controlled printing devices.

Many different types of digitally controlled imaging or printing systems are known. These systems utilize a variety of actuation mechanisms, marking materials and recording media. Examples of such systems include, but are not limited to, laser electrophotographic printers, LED electrophotographic printers, dot matrix impact printers, thermal paper printers, film recorders, thermal wax printers, dye diffusion thermal transfer printers, and ink jet printers. Due to various disadvantages or limitations, such digital printing systems have not significantly replaced mechanical printing presses and the more conventional printing plates described above, even though these older systems are labor intensive and inexpensive only when more than a few thousand copies of the same image are wanted. Yet, there is considerable activity in the industry to prepare recording media that can be digitally imaged and used to provide high quality, inexpensive copies in either a short- or long run job.

Ink jet printing has become recognized as a viable alternative in the industry because of its non-impact deposition of ink droplets, low-noise characteristics, its use of plain paper as a receiving material, and its avoidance of toner transfer and fixing (as in electrophotography). Ink jet printing mechanisms can be characterized as either continuous ink jet or "drop on demand" ink jet printing.

Various ink jet printers and systems are currently available for a number of markets, including their common use with personal computers. A very essential aspect of such systems, of course, is a printing ink that has all of the necessary properties for a given application.

Various teachings about ink jet printing including nozzles and drop modulation are described, for example, in U.S. Pat. No. 1,941,001 (Hamsell), U.S. Pat. No. 3,373,437 (Sweet et al.), U.S. Pat. No. 3,416,153 (Hertz et al.), U.S. Pat. No. 3,878,519 (Eaton), and U.S. Pat. No. 4,346,387 (Hertz).

Printing plates have been made using ink jet printing, as described for example in U.S. Pat. No. 4,003,312 (Gunther), U.S. Pat. No. 4,833,486 (Zerillo), U.S. Pat. No. 5,501,150 (Leenders et al.), U.S. Pat. No. 4,303,924 (Young), U.S. Pat. No. 5,511,477 (Adler et al.), U.S. Pat. No. 4,599,627 (Vollert), U.S. Pat. No. 5,466,658 (Harrison et al.), and U.S. Pat. No. 5,495,803 (Gerber et al.).

JP Kokai 56-105960 describes ink jet printing using an ink comprising a hardening substance, such as an epoxy-soybean oil, and benzoyl peroxide, or a photohardenable polyester, onto a metallic support. These inks are disadvantageous in that they include light-sensitive materials or environmentally unsuitable organic solvents.

EP-A-0 776,763 (Hallman et al.) describes ink jet printing of two reactive inks that combine to form a polymeric resin on a printing plate. JP Kokai 62-25081 describes the use of an oleophilic liquid as an ink jet ink.

Inks for high-speed ink jet drop printers must have a number of special characteristics. Typically, water-based inks have been used because of their conductivity and viscosity range. Thus, for use in a jet drop printer the ink must be electrically conductive, having a resistivity below about 5000 ohm-cm and preferably below about 500 ohm-cm. For good fluidity through small orifices, the water-based inks generally have a viscosity in the range between 1 and 15 centipose at 25° C.

Beyond this, the inks must be stable over a long period of time, compatible with ink jet materials, free of microorganisms and functional after printing. Required functional characteristics include resistance to smearing after printing, fast drying on paper, and being waterproof when dried.

Thus, problems to be solved with aqueous ink jet inks include the large energy needed for drying, cockling of large printed areas on paper surfaces, ink sensitivity to rubbing, the need for an anti-microbial agent and clogging of the ink jet printer orifices from dried ink.

Some of these problems may be overcome by use of polar, conductive organic solvent-based ink formulations. However, non-polar solvents generally lack sufficient conductivity. Addition of solvent soluble salts can make such solvents conductive, but such salts are often toxic, corrosive and unstable, and therefore present a number of reasons why they should be avoided. Also, to prepare a lithographic printing plate by ink jet methods, the ink jet fluid must make an image area that has an affinity for lithographic ink, in addition to the aforementioned requirements for the ink jet fluid.

SUMMARY OF THE INVENTION

It is an object of the present invention to prepare lithographic printing plates which can be made by ink jet printing and can be used without requiring electrically conductive ink and without the problems noted above particularly for aqueous inks.

This object is achieved by a method for preparing a lithographic plate which can react with an imaging fluid to form an image, comprising the steps of:

a) providing a hydrophilic support;

b) forming a fluid-receiving layer that includes a water-soluble material which is chemically reactive with the imaging fluid, c) imagewise applying the imaging fluid to the fluid-receiving layer; and d) drying or curing the applied fluid to form an image in the fluid-receiving layer.

ADVANTAGES

Lithographic printing plates prepared according to the present invention are longwearing and particularly useful for long press runs.

In this invention, the applied fluid is dried or cured to form a durable, solvent-insoluble, oleophilic image on the fluid-receiving element. Non-imaged areas of the fluid-receiving layer can be by the lithographic printing process. The printing elements are easily and economically prepared using an ink jet printer, provide long press runs with high quality images.

Another advantage of the plates prepared by this invention is that the resulting imaging member is protected from damage from handling during mounting on a printing press (for example, fingerprints, smudging and other handling defects) because the non-imaged fluid-receiving layer can be removed in the printing process.

DETAILED DESCRIPTION OF THE INVENTION

The following description of this invention is directed to the use of particular embodiments of ink jet fluids, imaging members and methods of their preparation and use. It is to be understood that embodiments not specifically described, but which would be variations obvious to one skilled in the art, are also included within the present invention.

Figure 1:
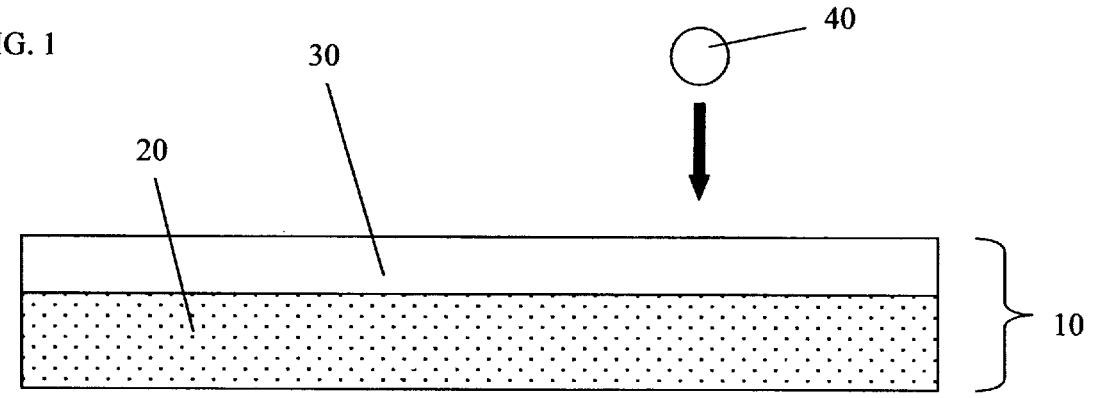
FIG. 1 is cross-sectional view of an imaging member used in the practice of this invention to which an ink jet fluid droplet is being applied.

Considering FIG. 1, imaging member 10 includes hydrophilic support 20 having disposed thereon fluid-receiving layer 30. Droplet 40 of an ink jet fluid is being applied to the surface of fluid-receiving layer 30 in the direction of the arrow.

Figure 2:
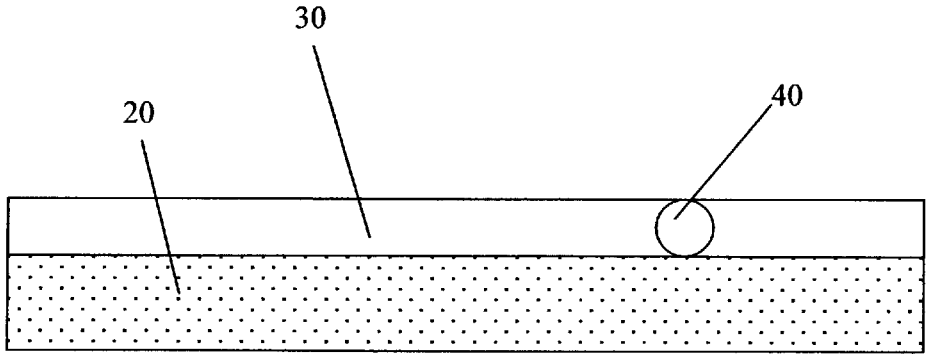
FIG. 2 is cross-sectional view of the imaging member shown in FIG. 1, after application of the ink jet fluid droplet, and the applied droplet has been dried or cured and has become attached to the hydrophilic support.

In FIG. 2, ink jet fluid droplet 40 has been absorbed within fluid-receiving layer 30 and has come into contact with and become attached to hydrophilic support 20, as well as chemically reacting with the fluid-receiving layer to form a crosslinked matrix.

When the liquid component of ink jet fluid droplet is removed in a suitable fashion (such as by drying or curing), the resulting cured or dried fluid forms an imaged area. Upon contact with a lithographic printing ink and fountain solution, non-imaged areas of the fluid-receiving layer can be removed leaving only the imaged area.

The hydrophilic supports useful in the present invention are generally adhesive, when wet with fountain solution, to lithographic printing inks, and receptive to water. Such supports can be composed of metal, paper or polymer (such as polyesters or polyimides) sheets, foils or laminates thereof, as long as they have the requisite properties. Metal supports (such as aluminum, zinc or steel) are preferred for their dimensional stability. A particularly useful support is aluminum that has a roughened surface (using physical or chemical roughening to produce surface hydroxy groups) for improved hydrophilicity. Such supports will effectively repel lithographic printing inks and "hold" or accept water (or an aqueous fountain solution).

Polymeric supports can also be used for monochrome or spot color printing jobs where the positional variations or lack of dimensional stability is not important.

The polymeric supports must be treated or provided with a hydrophilic surface. For example, a hydrophobic polyethylene terephthalate or polyethylene naphthalate film can be coated with a hydrophilic subbing layer composed of, for example, a dispersion of titanium dioxide particles in crosslinked gelatin to provide a roughened surface. Paper supports can be similarly treated and used in the practice of this invention.

Supports can have any desired thickness that would be useful for a given application, and to sustain the wear of a printing press and thin enough to wrap around a printing form, for example from about 100 to about 500 microns in thickness.

The fluid-receiving layer 30 in the imaging member has a composition that enables it to receive (or possibly absorb or dissolve) the applied fluid, and chemically react with components of the fluid which are oleophilic and adhesive to lithographic printing ink, thus providing a tough, long lasting image surface which can print many press impressions without image degradation due to physical wear.

In a preferred embodiment of this invention, the applied fluid includes a polymer which has both groups which are chemically reactive with epoxide functionality and nitrogen heterocyclic groups such as the pyridine moiety. Such chemically reactive groups are hydroxy groups, amine groups and thiol groups, all of which will react with epoxide groups included in the fluid-receiving layer 30. Aromatic heterocyclic nitrogen groups include, but are not limited to, pyridine, quinaldine, pyrrolyl, imidazole, pyrazole, pyrazine, pyrimidine, pyridazine, indolizine, isoindole, indole, quinoline, isoquinoline, quinoxaline, quinazoline, acridine, carbazole, cinnoline, pteridine, phenanthridine, and perimidine. The purpose of including the aromatic heterocyclic nitrogen group on the polymer included in the droplets 40 is to improve adhesion of lithographic printing ink to the image area, while also providing water solubility of the polymer in the droplets 40. An unexpected improvement of ink adhesion to water soluble polymers which contain aromatic heterocyclic nitrogen groups has been found. It will be understood by those skilled in the art of polymer chemistry that water solubility of an aromatic heterocyclic nitrogen containing polymer is enhanced by including an acid such as acetic acid in the water.

The fluid-receiving layer 30 rapidly absorbs, or dissolves within, the applied droplets 40 so that upon drying, the functional groups on the polymer included in the droplets 40 react with the epoxide functionality of the fluid-receiving layer 30 to form a crosslinked matrix, and the area to which the fluid is applied is discrete and the fluid-receiving layer can become firmly attached to the underlying hydrophilic support in some manner. In addition, the non-imaged areas of the fluid-receiving 30 layer must be sufficiently soluble in water or conventional fountain solutions so it can be removed after imaging. Thus, the non-imaged areas may be removed when ink and a fountain solution are applied or in a separate step prior to inking.

An important function of the image-receiving layer is to prevent fingerprints or other handling defects on the hydrophilic support surface. As an example of the problem, when anodized aluminum is used as the hydrophilic support, a fingerprint made during mounting of the resulting imaging member onto a printing press, will sometimes "print" ink for several hundred impressions before being worn away. This is costly in time and the receiving materials onto which ink is printed, and reduces print quality.

The fluid-receiving layer, because it is water-soluble, is washed off after imaging with the fountain solution, removing any fingerprints thereon. However, it is important that the fluid-receiving layer does not prevent the attachment of the applied droplet to the hydrophilic support, or the resulting image will be worn away after a few impressions as the non-imaged areas of the fluid-receiving layer are dissolved in the fountain solution. The fluid-receiving layer can allow attachment to the hydrophilic support by reacting with the dried or cured fluid droplet, thus becoming a part of the dried polymeric matrix in the imaged areas. Alternatively, the fluid-receiving layer can become physically entangled with the polymeric matrix formed by the dried or cured fluid droplet.

The fluid-receiving layer is therefore composed of generally water-soluble materials such as CR5L, a water-soluble epoxy from the Esprit Chemical Company of Sarasota, Fla. and Denacol EX614 and EX614B, both Sorbitol Polyglycidyl Ethers from Nagase Chemicals Ltd. of Osaka, Japan. By "water-soluble" is meant that a material can form a greater than 1% solution in water or a mixture of a water miscible solvent such as alcohol and water wherein the mixture is more than 50% water.

It will be understood by those skilled in the art that a water-soluble polymer can be rendered water-insoluble by chemical crosslinking without significantly changing the hydrophilic surface properties. For the purposes of this disclosure, such crosslinked polymers are considered water-soluble polymers as long at they are water soluble before any crosslinking occurs.

Although the preferred reactive fluid-receiving layer is an epoxy, other reactive fluid-receiving layers are also possible. Following is a list of some reactive fluid-receiving layer materials and the corresponding ink jet fluid reagent.

1. Aviden or streptaviden. These proteins form a strong bond with the biotin group upon contact. Thus, a water-soluble polymer with an affinity for lithographic ink and containing the biotin group will serve as an ink jet fluid for this invention. Further details can be found in "Bioconjugate Techniques" by Greg T. Hermanson, Academic Press, New York (see page 372).

2. A photoreactive compound such as sulfosuccinimidyl-2-(p-azido-salicylamido)ethyl-1,3'-dithiopropionate can be used to thermally link a lithographic ink receptor for forming a fluid for this invention and, after ink jet printing, photochemically link the fluid to a receiving layer (see page 257 of the above cited Greg T. Hermanson reference).

3. In a similar way to 2, 4-(4-N-maleimidophenyl)butyric acid hydrazide hydrochloride can be used to thermally react first with a sulfhydro containing compound to provide a fluid of this invention and then with an aldehyde containing fluid-receiving layer to provide the image of this invention.

The materials in the fluid-receiving layer 30 can be applied to the hydrophilic support in any suitable manner using conventional coating equipment and procedures. Upon drying, the fluid-receiving layer is generally at least 0.1 micron in thickness and can be as thick as 10 microns. Thus, it must be thick and substantially continuous enough to provide the desired image upon fluid application, but not so thick that the non-imaged areas are difficult to remove after imaging.

The applied imaging fluid used to make the imaging members is preferably an aqueous solution or dispersion of one or more materials that can be dried or cured to form an insoluble matrix within the fluid-receiving layer. Other solvents can be used as long as they are readily removed after fluid application and do not adversely affect the fluid-receiving layer.

In a preferred embodiment of the invention, the fluid is an aqueous acetic acid solution of polyvinylpyridine-co-polyhydroxyethylmethacrylate. Generally, the amount of the polymer in the fluid is at least 1 weight %, and preferably at least 3 weight %, and can be as high as 10 weight %. The surface tension of the fluid is generally at least 20 and preferably at least 30 dynes/cm, and generally up to 60 and preferably up to 50 dynes/cm. Surface tension can be measured in a conventional manner, for example, using a commercially available du Nony Tensiometer (Scientific Products, McGaw Park, Ill.). Fluid viscosity can be generally no greater than 20 centipoise, and preferably from about 1 to about 10, and more preferably from about 1 to about 5, centipoise. Viscosity is measured in a conventional manner, for example, using a commercially available Brookfield Viscometer. It will be understood by those skilled in the art of polymer chemistry that the viscosity of the solution can be changed both by changing the concentration of the polymer in the fluid and by changing the molecular weight of the polymer.

The fluids used in this invention can also include other addenda, including organic anionic or nonionic surfactants to provide the desired surface tension (for example, those described in U.S. Pat. Nos. 4,156,616, 5,324,349 and 5,279,654), humectants or co-solvents to keep the fluid from drying out or clogging the orifices of ink jet print heads, penetrants to help the fluid penetrate the surface of the support. A biocide, such as PROXEL™ GXL biocide (Zeneca Colors) or KATHON™ XL biocide (Rohm and Haas) may also be included to prevent microbial growth. Other addenda may be thickeners, pH adjusters, buffers, conductivity enhancing agents, drying agents and defoamers. The amounts of such materials in the fluids would be readily apparent to one skilled in the art. Preferably, the fluids are colorless, but may also contain soluble or dispersed colorants.

The fluids described herein can be applied to the fluid-receiving layer in any suitable manner that provides droplets to its surface in an imagewise fashion. Preferably, they are applied using ink jet printing techniques and devices. Thus, the fluid can be applied using ink jet printing in a controlled, imagewise fashion to the surface of the fluid-receiving layer by ejecting droplets from a plurality of nozzles or orifices in a print head of an ink jet printer (such as a piezoelectric ink jet printing head). Commercially ink jet printers use various schemes to control the deposition of the droplets. Such schemes are generally of two types: continuous stream, and drop-on-demand. In drop-on-demand systems, the fluid droplets are ejected from orifices directly to a position on the support by pressure created by, for example, a piezoelectric device, an acoustic device, or a resistive heater controlled in accordance with digital signals. Thus, fluid droplets are not generated and ejected through the orifices of the print head unless they are needed to print pixels. Commercially available ink jet printers using such techniques are well known and need not be described in detail here.

Continuous ink jet printers have smaller drops and can be used, but the fluids must be conductive because the fluid droplets are deflected between the receiving material and a collection gutter by electrostatic deflectors. The fluids described herein can have properties compatible with a wide range of ejecting conditions, for example, driving voltages and pulse widths for thermal ink jet printers, driving frequencies of the piezoelectric element for either a drop-on-demand device or a continuous device, and the shape and size of the nozzles.

Once the fluid has been applied to the fluid-receiving layer, the solvent is removed in any suitable fashion, such as drying, wicking, evaporation, sublimation or combinations thereof. Drying can be accomplished using any suitable source of energy that will evaporate the liquid without harming the water-insoluble matrix that is formed in the fluid-receiving layer. Preferably, the imaging member is dried to form the durable, water-insoluble, inorganic polymeric matrix described above. Drying means and conditions can vary depending upon the viscosity of the fluid, the solvent used, and various other features. The applied fluid may be heated to speed up the drying process. Usual drying of the imaging member would be for example at a temperature of at least 100° C. for at least 30 seconds. If the fluid requires curing to cause a desired chemical reaction, curing can be accomplished by ultraviolet radiation, electron beam radiation or gamma radiation.

The dried or cured image on the imaging member is then ready for a printing operation. Before inking the image, non-imaged areas of the fluid-receiving layer can be removed using an aqueous solution such as a fountain solution.

The resulting imaging member having an imagewise insoluble polymeric matrix on the hydrophilic support, can then be inked with a suitable lithographic printing ink (for example, with a fountain solution), and the inked image is then transferred to a suitable receiving material, such as paper, metal sheets or foils, ceramics, fabrics and other materials known in the art. The image can be transferred directly to the receiving materials, or indirectly by transfer first to what is known as a blanket roller, which in turn transfers the ink image to the receiving material.

The imaging members prepared using the present invention can be of any suitable shape or form, including but not limited to, printing plates, printing tapes (or webs), and printing cylinders or drums. Preferably, the imaging member is a printing plate. The following examples are presented to illustrate, but not limit, the present invention.

EXAMPLE 1

This example demonstrates the practice of the present invention.

A colorless ink jetable fluid was prepared by mixing 250 mg of a 15:85 copolymer of 2-hydroxyethylmethacrylate and 4-vinylpyridine with 3 g of water, 1 g of diethyleneglycol monobutyl ether, and 0.5 g of acetic acid. This fluid was then loaded onto a cotton swab by dipping and the swab was streaked across a grained anodized aluminum printing plate which had been coated with 0.7 g of CR5L, a water-soluble epoxy from the Esprit Chemical Company of Sarasota, Fla. dissolved in a mixture of 5 ml of isopropyl alcohol and 2 ml of water. The wet coating thickness of 10 micron was accomplished with a wire wound rod. After coating the lithographic printing plate was allowed to air dry overnight. After the fluid had been streaked onto the plate, the plate was dried and cured by heating in a 100° C. oven for 15 minutes. After curing, the resulting printing plate was mounted on a commercially available A. B. Dick duplicator printing press and inked using a conventional lithographic ink and fountain solution. Five thousand excellent impressions were made with good ink density in the areas where the fluid had been applied to the plate. In addition, this printing plate had excellent protection from fingerprints.

EXAMPLE 2

A 1% solution of the copolymer of Example 1 was prepared in water with sufficient acetic acid to provide a clear solution. This fluid was filtered through a 0.45 micron filter and loaded into an empty ink jet cartridge made to fit an Epson Stylus Color 900 ink jet printer. A plate was prepared as in Example 1. The plate was printed with the ink jet fluid, dried and cured by baking in a 100° oven for 15 minutes. The plate was then mounted on an ABDick press and 500 excellent impressions were made.

EXAMPLE 3

The experiment of Example 2 was repeated, but the epoxy used was Denacol EX614. Again, 500 excellent impressions were made.

EXAMPLE 4

The experiment of Example 3 was repeated, but the epoxy used was Denacol EX614B. Again, 500 excellent impressions were made.

The invention has been described in detail with particular reference to preferred embodiments thereof, but it will be understood that variations and modifications can be effected within the spirit and scope of the invention.

PARTS LIST

10 imaging member
20 hydrophilic support
30 fluid-receiving layer
40 droplets

What is claimed is:

1. A method for preparing a lithographic plate which can react with an imaging fluid to form an image, comprising the steps of:

a) providing a hydrophilic support;

b) forming a fluid-receiving layer that includes a water-soluble epoxy resin substantially free from metal ions which is chemically reactive with the imaging fluid;

c) imagewise applying the imaging fluid to the fluid-receiving layer; and d) drying or curing the applied fluid to form an image in the fluid-receiving layer.

2. The method of claim 1 wherein the imaging fluid includes a solution having water and a polymer including pyridine or quinoline groups.

3. The method of claim 1 wherein the polymer further includes functional groups which react with the water-soluble epoxy resin.

4. A lithographic plate which can react with an imaging fluid to form an image, comprising:

a) a hydrophilic support; and b) a fluid-receiving layer that includes a water-soluble epoxy resin substantially free from metal ions which is chemically reactive with the imaging fluid so that after imagewise applying the imaging fluid to the fluid-receiving layer, and drying or curing the applied fluid an image will be formed in the fluid-receiving layer.

5. The lithographic plate of claim 4 wherein the imaging fluid includes a solution having water and a polymer including pyridine or quinoline groups.

6. The lithographic plate of claim 4 wherein the polymer further includes functional groups which react with the water-soluble epoxy resin.

7. A method for preparing a lithographic plate which can react with an imaging fluid to form an image, comprising the steps of:

a) providing a hydrophilic support;

b) forming a fluid-receiving layer that includes a water-soluble epoxy resin substantially free from metal ions which is chemically reactive with the imaging fluid;

c) imagewise applying the imaging fluid to the fluid-receiving layer and such imaging fluid including a polymer including aromatic heterocyclic nitrogen groups; and d) drying or curing the applied fluid to form an image in the fluid-receiving layer.

* * * * *